US006396465B1

(12) United States Patent
Nakagiri

(10) Patent No.: US 6,396,465 B1
(45) Date of Patent: May 28, 2002

(54) DEVICE AND METHOD FOR DISPLAYING GRAY SHADES

(75) Inventor: Masato Nakagiri, Shizuoka (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/436,537

(22) Filed: Nov. 9, 1999

(30) Foreign Application Priority Data

Nov. 10, 1998 (JP) ..... 10-333353

(51) Int. Cl.[7] ..... G09G 5/10

(52) U.S. Cl. ..... 345/69; 345/691; 345/600; 345/89

(58) Field of Search ..... 345/690, 691, 345/692, 693, 694, 695, 696, 698, 87, 88, 89, 593, 596, 597, 598, 599, 600

(56) References Cited

U.S. PATENT DOCUMENTS 5,119,086 A * 6/1992 Nishioka et al. ..... 345/690
5,552,800 A * 9/1996 Uchikoga et al. ..... 345/690
5,619,227 A * 4/1997 Takebe ..... 345/690
6,084,561 A * 7/2000 Kudo et al. ..... 345/690
6,208,467 B1 * 3/2001 Naka et al. ..... 345/690

* cited by examiner

*Primary Examiner*—Xiao Wu
(74) *Attorney, Agent, or Firm*—Hutchins, Wheeler & Dittmar

(57) ABSTRACT

A gray shade displaying device and a method of displaying gray shades wherein its circuit configurations can be simplified, thus reducing power consumption and related costs and allowing values of products using the device and method to be maintained high. By deciding color data corresponding to given image data using a color data determining means, by providing a display pattern corresponding to the color data using a pattern recognizing means, by deciding gray scale data providing a specified shade of gray by giving frame rate control to the color data through a frame rate controlling means and by employing an Extension register provided within the pattern recognizing means, whether an intermediate gray shade is displayed or not is decided. Furthermore, by deciding color data corresponding to given image data using a color data determining means, by providing a display pattern corresponding to the color data using a pattern recognizing means and by deciding gray scale data providing a specified shade of gray by giving frame rate control to the color data through a frame rate controlling means and by employing an Extension register provided within the frame rate controlling means, whether an intermediate gray shade is displayed or not is decided.

12 Claims, 17 Drawing Sheets

FIG.1

| N-th gray scale | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| (N)th gray scale | 0a | 1a | 2a | 3a | 4a | 5a | 6a | 7a | 8a | 9a | 10a | 11a | 12a | 13a | 14a | 15a |

| intermediate gray scale | 0 | 1a | 2a | 3a | 4a | 5a | 6a | 7a | 8a | 9a | 10a | 11a | 12a | 13a | 14a | 15a |
|---|---|---|---|---|---|---|---|---|---|---|---|---|---|---|---|---|

*FIG.5*

| *color data(n=4)* | *gray shade register to be selected* |
|---|---|
| *0000* | *gray shade register 0* |
| *0001* | *gray shade register 1* |
| *0010* | *gray shade register 2* |
| *0011* | *gray shade register 3* |
| *0100* | *gray shade register 4* |
| *0101* | *gray shade register 5* |
| *0110* | *gray shade register 6* |
| *0111* | *gray shade register 7* |
| *1000* | *gray shade register 8* |
| *1001* | *gray shade register 9* |
| *1010* | *gray shade register 10* |
| *1011* | *gray shade register 11* |
| *1100* | *gray shade register 12* |
| *1101* | *gray shade register 13* |
| *1110* | *gray shade register 14* |
| *1111* | *gray shade register 15* |

*FIG. 7*

| | | *low order 1 bit of value x* | |
|---|---|---|---|
| | | *"0"* | *"1"* |
| *low order 1 bit of value y* | *"0"* | *pattern A* | *pattern B* |
| | *"1"* | *pattern B* | *pattern A* |

*FIG.13 (PRIOR ART)*

| | color data(n=2 ×3) | gray shade register to be selected |
|---|---|---|
| R | 00 | gray shade register 0 |
| | 01 | gray shade register 1 |
| | 10 | gray shade register 2 |
| | 11 | gray shade register 3 |
| G | 00 | gray shade register 4 |
| | 01 | gray shade register 5 |
| | 10 | gray shade register 6 |
| | 11 | gray shade register 7 |
| B | 00 | gray shade register 8 |
| | 01 | gray shade register 9 |
| | 10 | gray shade register 10 |
| | 11 | gray shade register 11 |

*FIG.15 (PRIOR ART)*

| | | *low order 1 bit of value x* | |
|---|---|---|---|
| | | *"0"* | *"1"* |
| *low order 1 bit of value y* | *"0"* | *pattern A* | *pattern B* |
| | *"1"* | *pattern B* | *pattern A* |

FIG. 16A (PRIOR ART)

*frame rate controlling pattern A*

| gray shade register (bit) | 3 | 2 | 1 | 0 |
|---|---|---|---|---|
| value of a frame function | 3 | 2 | 1 | 0 |

FIG. 16B (PRIOR ART)

*frame rate controlling pattern B*

| gray shade register (bit) | 0 | 3 | 2 | 1 |
|---|---|---|---|---|
| value of a frame function | 3 | 2 | 1 | 0 |

DEVICE AND METHOD FOR DISPLAYING GRAY SHADES

BACKGROUND OF THE INVENTION

1. Field of the Invention

The present invention relates to a gray shade displaying device and a method for displaying gray shades being suitable for use in an LCD (liquid crystal display) to display a color image in multiple shades of gray on a display of a computer, TV or the like.

2. Description of the Related Art

The LCD is now in increasing demand and further being developed rapidly, instead of a CRT (Cathode Ray Tube), for reasons that it does not occupy a large area for its installation, consumes power little and has little adverse effect on a human body.

In particular, a DSTN (Dual Supper Twisted Nematic)-type or STN (Super Twisted Nematic)-type LCD (hereinafter referred to simply as an "STN-LCD") is increasing popular, among manufacturers, as a means of displaying images which can be designed or manufactured at a low cost.

Paralleling the widespread use of the LCD, the need for displaying a variety of varicolored images using gray-scale colors is increasing in the field of display technology for a computer or the like.

One pixel (color element) forming the LCD screen is represented by two values, one for a "light state" and the other for a "dark state" and, therefore, the gray-scale color can not be displayed by one pixel. To solve this problem, in a TFT (Thin Film Transistor)-type LCD which reacts quickly to a signal, by changing a ratio of time (i.e., duty ratio) between the light and dark states taken by one pixel, images can be displayed in multiple shades of gray.

However, such a method as used in the TFT-type LCD cannot be applied to the STN-LCD due to its slow reaction to a signal. In general, therefore, a method is adopted where one dot forming an image is composed of two or more pixels. For example, to display an image in 4 shades of gray, one dot is composed of 4 pixels and the number of pixels for the "light" state is changed depending on shades of gray to be displayed.

Conventionally, the STN-LCD for displaying images in multiple shades of gray is provided with a LCD controller to perform the processing described above.

FIG. 10 is a block diagram showing configurations of a conventional LCD controller used to display an image on an STN-type or DSTN-type color LCD panel. As shown in FIG. 10, the conventional LCD controller is comprised of an image memory interface 101, a color data determining section 102, a frame rate controlling section 103, a display control signal outputting section 104 and a pattern recognizing section 105. The image memory interface 101 is adapted to derive an image signal from the image memory. The color data determining section is used to produce color data for each of RGB (Red, Green and Blue colors, three primaries) colors using the image signal derived through the image memory interface. The frame rate controlling section is used to display data for an LCD panel based on color data outputted from the color data determining section 102. The frame rate controlling section is also used to output display data for displaying gray shades and is provided with two or more gray shade registers (not shown) into which gray shade data corresponding to each color data is stored. The display control signal outputting section 104 is used to generate timing signals to display an image on the LCD panel in accordance with the display data. The pattern recognizing section 105 is used to output a pattern recognizing signal to indicate a position of a display pixel on the LCD panel.

The LCD panel has only a capability of displaying 2 values, one for a state of lighting and the other for a state of going off, in terms of its principles. To display an image in a shade of gray on the STN-type or DSTN-type color LCD panel, a method is available where one dot forming an image is composed of two or more pixels.

FIGS. 11A to 11C are explanatory views showing one example of methods for displaying gray shades on the LCD panel.

In FIGS. 11A to 11C, one dot is composed of 4 pixels and the gray shade is expressed by changing the number of pixels being in a state of lighting (a diagonally shaped area shows that the pixel is in a state of going off and a hollow portion showing that the pixel is in a state of lighting). That is, FIG. 11A shows that one dot is turned off or is in a state of going off while FIG. 11C showing that one dot is turned on or in a state of lighting. FIG. 11B is an example of displaying of a gray-scale color.

Hereinafter, by taking the case of displaying 4 shades of gray as an example, operations of a conventional gray shade display using the LCD controller shown in FIG. 10 are described.

FIG. 12 is a flowchart indicating one example of flows of processing by the LCD controller used in the conventional gray shade displaying device.

First, the frame rate controlling section 103 selects a gray shade register corresponding to color data for each of R, G and B colors outputted from the color data determining section.

FIG. 13 is an explanatory diagram showing a gray shade register selected in accordance with each color data. The gray shade register is provided to correspond to color data. In the case of displaying 4 shades of gray, for example, as shown in FIG. 13, 2 bits of data is required for the color data and one gray shade register corresponding to color data is selected out of 4 ($2^2$) gray shade registers.

The gray shade register for each of the RGB colors may be provided independently or one gray shade register may be used in common for the RGB colors.

Next, the frame rate controlling section 103 selects a specified frame rate controlling pattern in accordance with the pattern recognizing signal indicating a position of the display pixel on the LCD panel (Step St2). The pattern recognizing signal outputted from the pattern recognizing section 105 is a signal indicating the position of the display pixel, which is represented by pixel values (x, y). The pattern recognizing signal outputted from the pattern recognizing section 5 is a signal indicating a position of a display pixel, which is represented by pixel values (x, y).

FIG. 14 is an explanatory view showing a relationship between each color element (dot) forming an image and the pixel values, which presents an image being 640 dots wide and 480 dots long.

As shown in FIG. 14, assuming that values existing at the upper-left portion on the image are (0, 0), values (1, 0) . . . (638, 0) and (639, 0) are disposed toward the right portion on the image and values (0, 1) . . . (0, 478) and (0, 479) are disposed downward on the image.

At this point, the frame rate controlling section 103 is adapted to select either of a frame rate controlling pattern A or B in accordance with low order 1 bit of the values x and y described above.

FIG. 15 is an explanatory view showing which frame rate controlling pattern, A or B, is selected by the frame rate controlling section 103 in accordance with values x and y (low order 1 bit).

FIGS. 16A and 16B are explanatory views showing contents of the frame rate controlling pattern A and B to be selected by the frame rate controlling section 103 respectively. In the case of the frame rate controlling pattern A, if the frame function is zero (0), the 0-th bit of the gray shade register is used for displaying and, similarly, if the frame function is 1, 2, or 3, the 1-st, 2-nd or 3-rd bit of the gray shade register are used for displaying. On the other hand, in the case of the frame rate controlling pattern B, if the frame function is zero (0), the 1-st bit of the gray shade register is used for displaying and similarly if the frame function is 1, 2 or 3, the 2-nd, 3-rd or 0-th bit are used for displaying as well.

Next, the frame rate controlling section 103 is adapted to set data which corresponds to a value of a frame function, selected out of data stored in the gray shade register selected by Step St1 in accordance with the frame rate controlling pattern selected by Step St2.

The frame function represents a function to be added each time one piece of a screen (i.e., one frame) of the LCD panel is filled with images. The frame rate controlling pattern is a pattern set in advance arbitrarily at the time of designing and, if the gray shade register contains 4 bits of data, 2 patterns are set as shown in FIGS. 16A and 16B. In the frame rate controlling pattern A shown in FIG. 16A, if the frame function is, for example, "zero (0)", bit 0 is selected for the gray shade register while if the frame function is "3", bit 3 is selected for the gray shade register.

Similarly, in the frame rate controlling pattern B shown in FIG. 16B, if the frame function is, for example, "zero (0)", bit 1 is selected for the gray shade register while if the frame function is "3", bit 0 is selected for the gray shade register.

In Step St3 described above, data (1 bit of data) of the gray shade register selected by the frame rate controlling section 103 is outputted as display data for each of the RGB colors on the LCD panel.

In the conventional LCD controller described above, if the number of bits of color data is "n", $2^n$ gray shade registers being $2^n$ bits long are required.

FIG. 17 is an explanatory view showing an ideal gray shade registers being able to be applied to the LCD controller described above. As shown in FIG. 17, registers designed specifically for use for each of the RGB colors and driving circuits having the number corresponding to these registers may be provided.

However, when many gray shade registers and driving circuits are provided within the LCD device, a problem occurs that power consumption is increased. Moreover, increased size of circuits causes a rise in costs as well.

It is apparent that the use of such LCDs as are costly and consume much power for recently-available portable devices including a portable phone or the like using a battery as its main power source causes the depreciation of values of such products.

SUMMARY OF THE INVENTION

In view of the above, it is an object of the present invention to provide a gray shade displaying device and a method of displaying gray shades wherein its circuit configurations can be simplified, thus reducing power consumption and related costs and allowing values of products using the device and method to be maintained high.

According to a first aspect of the present invention, there is provided a gray shade displaying device comprising:

a color data determining means to determine color data corresponding to given image data;

a pattern recognizing means to provide a display pattern corresponding to the color data and to decide shades of gray corresponding to color elements for RGB (red, green and blue) colors to which the determined color data belongs; and a frame rate controlling means to decide gray shade data providing a specified shade of gray by giving frame rate control to the color data and to decide a frame function to which each color element is allocated, whereby the pattern recognizing means has an extension register to decide whether an intermediate gray shade is displayed or not.

According to a second aspect of the present invention, there is provided a gray shade displaying device comprising:

a color data determining means to determine color data corresponding to given image data;

a pattern recognizing means to provide a display pattern corresponding to the color data and to decide shades of gray corresponding to color elements for RGB (red, green and blue) colors to which the determined color data belongs; and a frame rate controlling means to decide gray shade data providing a specified shade of gray by giving frame rate control to the color data and to decide a frame function to which each color element is allocated, whereby the frame rate controlling means has an extension register to decide whether an intermediate gray shade is displayed or not.

In the foregoing, a preferable mode is one wherein it is provided with N bits of gray shade registers each giving a different display pattern and wherein an intermediate gray shade is displayed in N shades of gray by using data contained in the gray shade register providing a higher shade of gray by one as one bit out of N bits of the gray shade registers.

Also, a preferable mode is one wherein the AND of specified low order bits of the color data is computed and, when the ANDed value is zero (0), the color data is judged to be the intermediate gray shade.

According to a third aspect of the present invention, there is provided a method of displaying gray shades comprising the steps of:

deciding color data corresponding to given image data by using the color data determining means;

providing a display pattern corresponding to the color data by using the pattern recognizing means;

deciding gray shade data providing a specified shade of gray by giving frame rate control to the color data by using the frame rate controlling means; and deciding whether an intermediate gray shade is displayed or not by using the extension register provided within the pattern recognizing means.

According to a fourth aspect of the present invention, there is provided a method of displaying gray shades comprising the steps of:

deciding color data corresponding to given image data by using the color data determining means;

providing a display pattern corresponding to the color data by using the pattern recognizing means;

deciding gray shade data providing a specified shade of gray by giving frame rate control to the color data by using the frame rate controlling means; and deciding whether an intermediate gray shade is displayed or not by using the extension register provided within the frame rate controlling means.

In the foregoing, it is preferable that it is provided with N gray shade registers each providing a different display pattern and wherein an intermediate gray shade is displayed in N shades of gray by using data of the gray shade register providing a higher shade of gray by one as one bit out of N bits of gray shade registers.

Also, it is preferable that the AND of specified low order bits of the color data is computed and, when the ANDed value is zero (0), the color data is judged to be the intermediate gray shade.

BRIEF DESCRIPTION OF THE DRAWINGS

The above and other objects, advantages and features of the present invention will be more apparent from the following description taken in conjunction with the accompanying drawings in which:

FIG. 1 is an explanatory view showing the principles of the present invention;

FIG. 5 is an explanatory view showing gray shade registers to be selected in accordance with each color data according to this embodiment;

FIG. 7 is an explanatory view showing which frame rate controlling pattern, A or B, is selected by the frame rate controlling section 3 in accordance with values x and y (low order 1 bit)

FIG. 13 is an explanatory diagram showing a gray shade register selected in accordance with each color data;

FIG. 15 is an explanatory view showing which frame rate controlling pattern, A or B, is selected by the frame rate controlling section 103 in accordance with values x and y (low order 1 bit);

FIGS. 16A and 16B are explanatory views showing contents of the frame rate controlling pattern A and B to be selected by the frame rate controlling section 103 respectively.

DETAILED DESCRIPTION OF THE PREFERRED EMBODIMENTS

Best modes of carrying out the present invention will be described in further detail using various embodiments with reference to the accompanying drawings.

In the gray shade displaying device of the present invention, by using a value of a frame function providing other shades of gray as a first bit of the original frame function applied to a STN-type or DSTN-type color LCD for 4,096 colors, a device for displaying 65, 536 colors is implemented.

To display 4,096 colors by using the STN-type or DSTN-type color LCD, 4 bits of color data for each of the RGB (three primaries) colors are outputted and displayed in 16 shades of gray. In the same manner, to display 536 colors, for example, 5 bits, 6 bits and 5 bits of color data are used for red, green and blue colors respectively and the red, green and blue colors are displayed in 32, 64 and 32 shades of gray respectively.

As shown in FIG. 1, by using a gray shade register for displaying in 16 shades of gray, data of a gray shade register providing a higher shade of gray by one is applied to one bit out of 16 bits. That is, instead of one bit out of 16 bits of the gray shade register, one bit of other gray shade register providing a different shade of grade by one scale is used for the position of one bit of the original gray shade register, which allows a gray-scale color between two shades of gray to be displayed. This enables displaying a gray-scale color that cannot be displayed in 16 shades of gray and displaying colors in more than 16 shades of gray. The gray shade register providing a higher shade of grade by one represents a register having a larger number of bits by one to instruct the pixel of the LCD to be turned on. The lighting of the pixel on the LCD panel is instructed by one bit out of N bits of the gray shade register.

Figure 2:
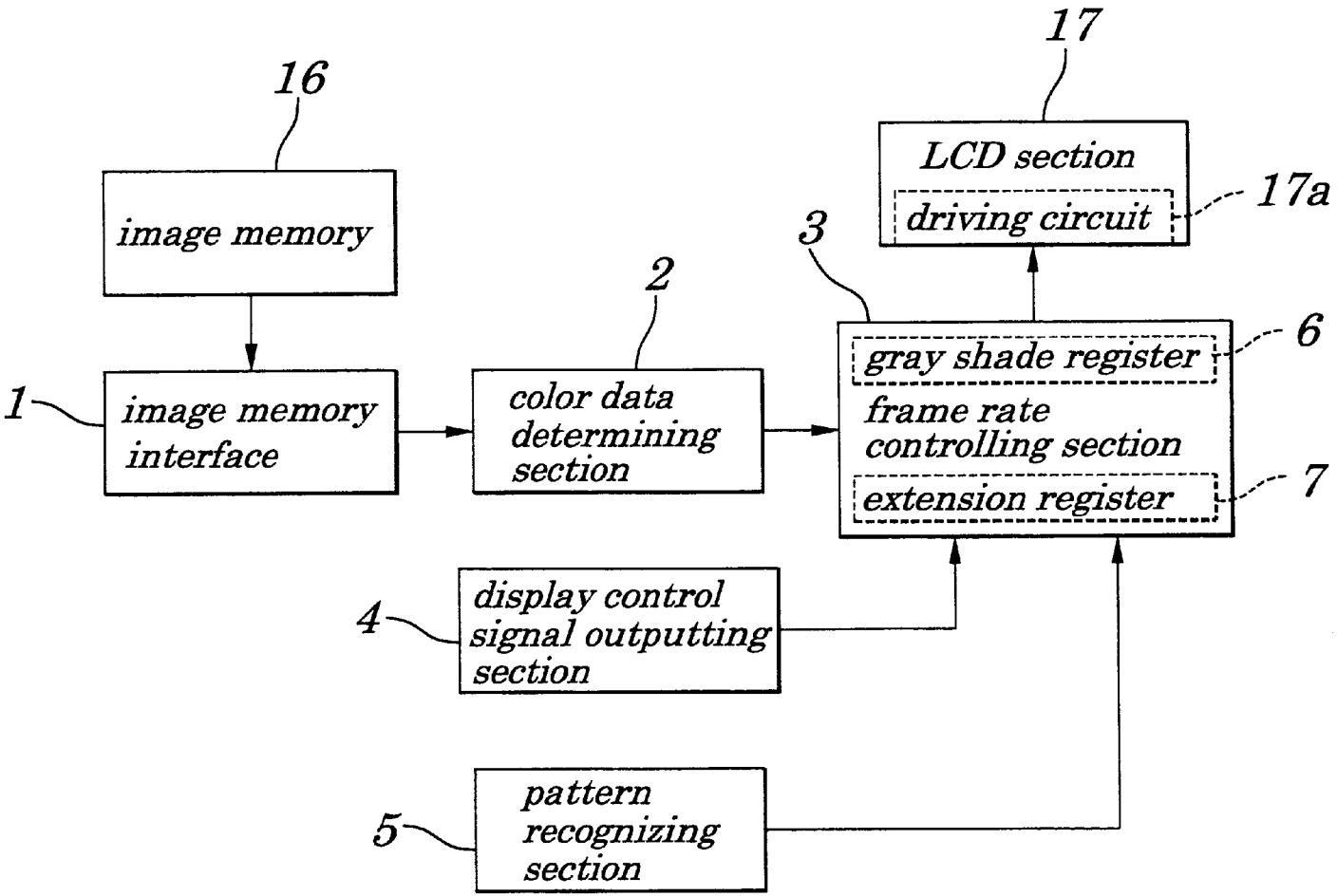
FIG. 2 is a block diagram showing configurations of a gray shade displaying device according to a first embodiment of the present invention.
Figure 3A:
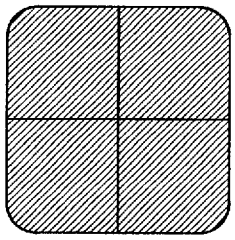
FIG. 3 is an explanatory view illustrating a lighting state of a pixel for each shade of gray designated by a pattern signal recognizing section 5.
Figure 3B:
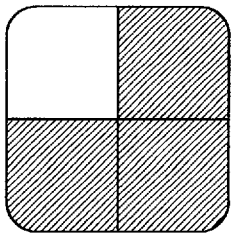
Figure 3C:
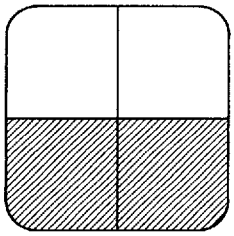
Figure 3D:
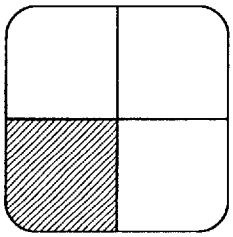
Figure 3E:
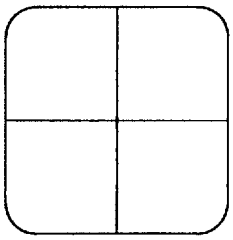

FIG. 2 is a block diagram showing configurations of a gray shade displaying device according to a first embodiment of the present invention. In FIG. 2, a reference number 1 shows an image memory interface to derive image signals from an image memory 16. A reference number 2 shows a color data determining section to produce color data for each of the RGB (three primaries) colors from the image signals derived through the image memory interface 1.

A number 3 shows a frame rate controlling section to supply display data to a driving circuit 17*a* contained in an LCD (Liquid Crystal Display) section 17 based on color data outputted from the color data determining section 2. The frame rate controlling section 3 is used to control the display data to display gray shades, having two or more gray shade registers 6 to store gray shade data corresponding to each color data and an extension register 7 to decide whether to display a gray-scale color or not. That is, the frame rate controlling section 3 is used to control or "thin out" color data to decide a frame function to which each color element is allocated. This enables displaying a gray-scale color that cannot be displayed in 16 shades of gray and displaying colors in more than 16 shades of gray.

A reference number 4 shows a display control signal outputting section to produce timing signals for displaying an image on the LCD section in accordance with the display data described above. A reference number 5 shows a pattern signal recognizing section to produce a pattern recognizing signal for indicating a position of a display pixel on the LCD section 17.

According to this embodiment, the extension register is provided to switch displaying 4,096/65,536 colors. That is, the switching of displaying 4,096/65,536 colors is enabled by rewriting values stored in the extension register 7.

FIG. 3 is an explanatory view illustrating a lighting state of a pixel for each shade of gray designated by the pattern signal recognizing section 5. The pattern recognizing section 5 is used to decide shades of gray corresponding to color elements of for RGB colors to which the determined color data belongs. In FIG. 3, the state of the lighting shows a case where the number of shades of gray is four, i.e., the state is displayed in 4 shades of gray and one dot is composed of 4 pixels. A hollow area contained in each dot shows that the pixel is in the state of lighting (ON) and a diagonally shaped area showing that the pixel is in the state of going off (OFF). FIG. 3A shows that any dot display is not provided. FIGS. 3B to 3E show that the display is produced in 1, 2, 3 and 4 shades of gray respectively.

Figure 4:
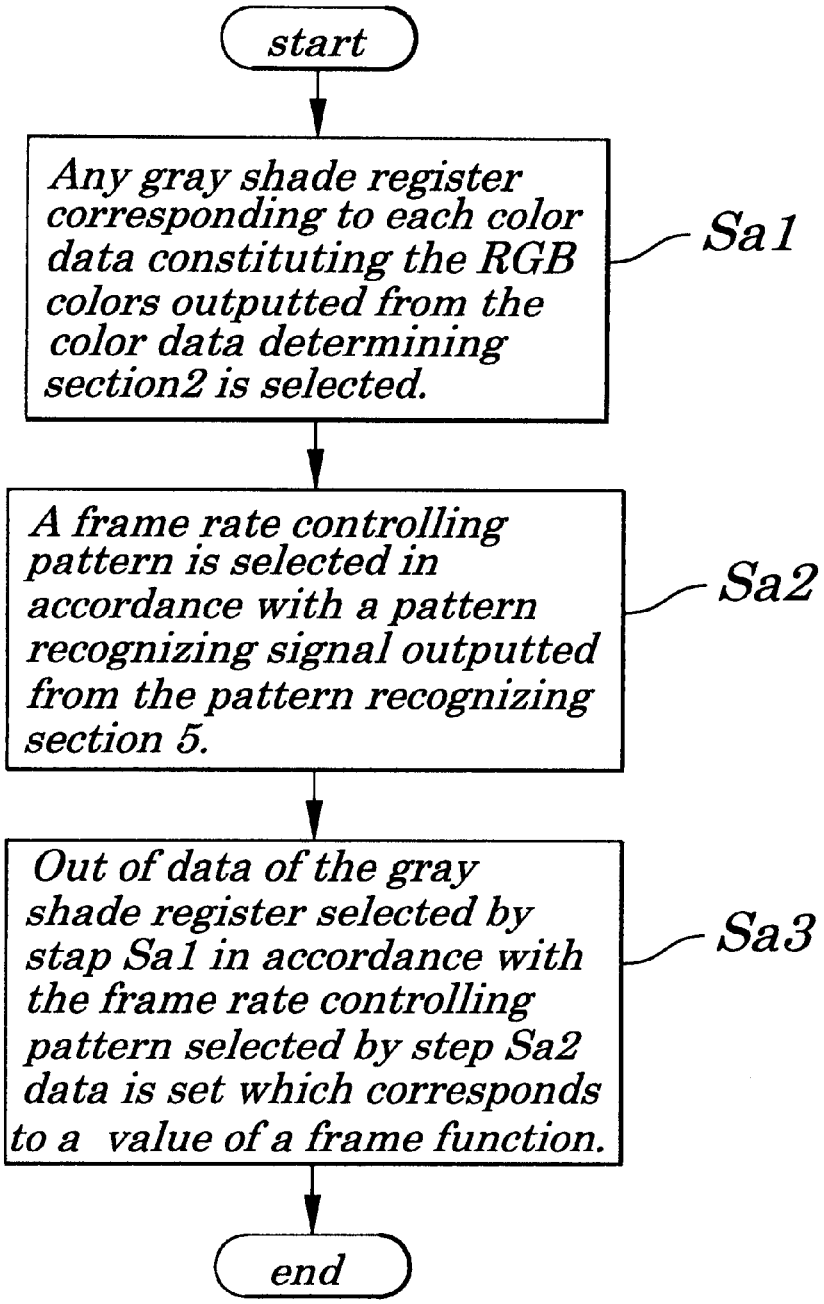
FIG. 4 is a flowchart indicating flows of processing according to this embodiment.

FIG. 4 is a flowchart indicating flows of processing according to this embodiment. The processing of this embodiment is described taking a case of 65,536 colors being displayed by the LCD section as an example.

FIG. 5 is an explanatory view showing a gray shade register to be selected in accordance with each color data according to this embodiment. First, the frame rate controlling section 3, which is used to control or "thin out" color data to decide a frame function to which each color element is allocated, selects any one of gray shade registers corresponding to color data constituting each of R, G and B colors (i.e., Red, Green and Blue, three primaries) outputted from the color data determining section 2. By setting the extension register 7 provided in the frame rate controlling section 3, whether color data constituting each of RGB colors is set to be displayed in 16 or 32 shades of gray is switched.

To display a color in 32 shades of gray, the number of bits for color data is 5, while it is 6 for displaying in 64 shades of gray. At this point, firstly high order 4 bits out of 5 or 6 bits are referred to.

The frame rate controlling section 3, based on 4 bits of the color data, selects a gray shade register corresponding to any gray scale on the basis of which the color data is displayed, out of 16 ($2^4$) gray shade registers as shown in FIG. 5 (Step Sa1).

Out of data contained in the gray shade register selected by Step Sa1 in accordance with the frame rate controlling pattern selected by Step Sa2, data corresponding to a value of a frame function is set.

If the color data is a gray-scale color that cannot be displayed in 16 shades of gray, the frame rate controlling section 3 is adapted to set only one bit of the frame function 0 to a value of the frame function 0 of a gray shade register providing a higher shade of gray by one.

Figure 6A:
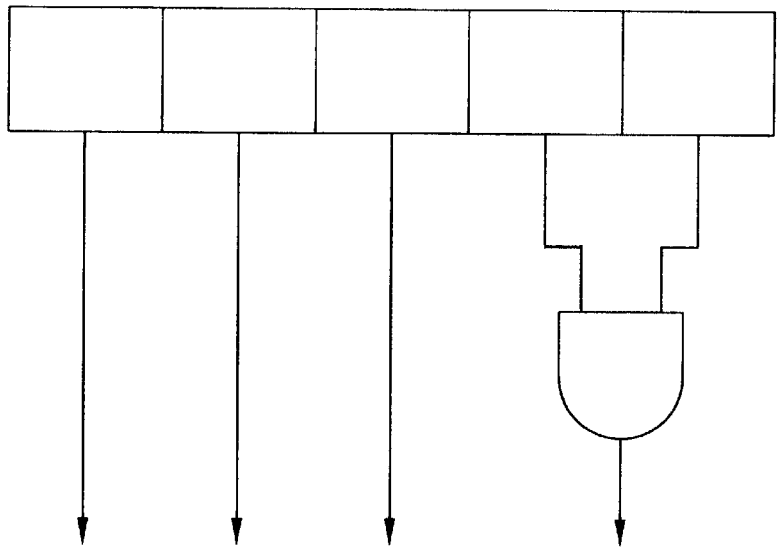
FIGS. 6A and 6B are explanatory views illustrating configurations used to judge whether color data is a gray-scale color or not, in particular in the case of the color data being 5 bits and 6 bits of data respectively.
Figure 6B:
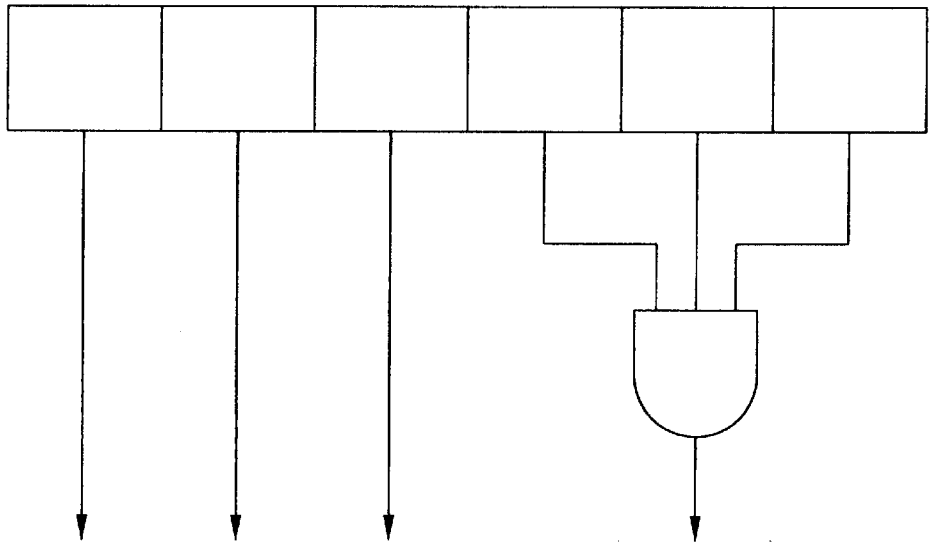

FIGS. 6A and 6B are explanatory views illustrating configurations used to judge whether color data is a gray-scale color or not, in particular, in the case of the color data being 5 bits and 6 bits of data respectively. In the case of the color data being a gray-scale color and of 4096 colors display mode, the low order 2 bits shown in 6A or low order 8 bits should be overwritten to be zero (0) by the frame rate controlling section. On the other hand, in the case of the color data being a gray-scale color and of 65,536 colors display mode, the presently existing bits shown in FIGS. 6A and 6B are used.

To judge whether a color data is a gray-scale color, as shown in FIG. 6A, if the color data is, for example, 5 bits of data, the AND of lower order 2 bits out of 5 bits is computed and if the resulting value is "zero (0)", it is judged to be the gray-scale color. On the other hand, if the color data is 6 bits of data, as shown in FIG. 6B, lower 3 bits out of 6 bits are ANDed and if the resulting value is "zero (0)", it is judged to be the gray-scale color.

Next, the frame rate controlling section 3 is adapted to select a specified frame rate controlling pattern in accordance with a pattern recognizing signal outputted from the pattern recognizing section 5 (Step Sa2). The pattern recognizing signal outputted from the pattern recognizing section 5 is a signal indicating a position of a display pixel, which is represented by pixel values (x, y).

Figure 14:
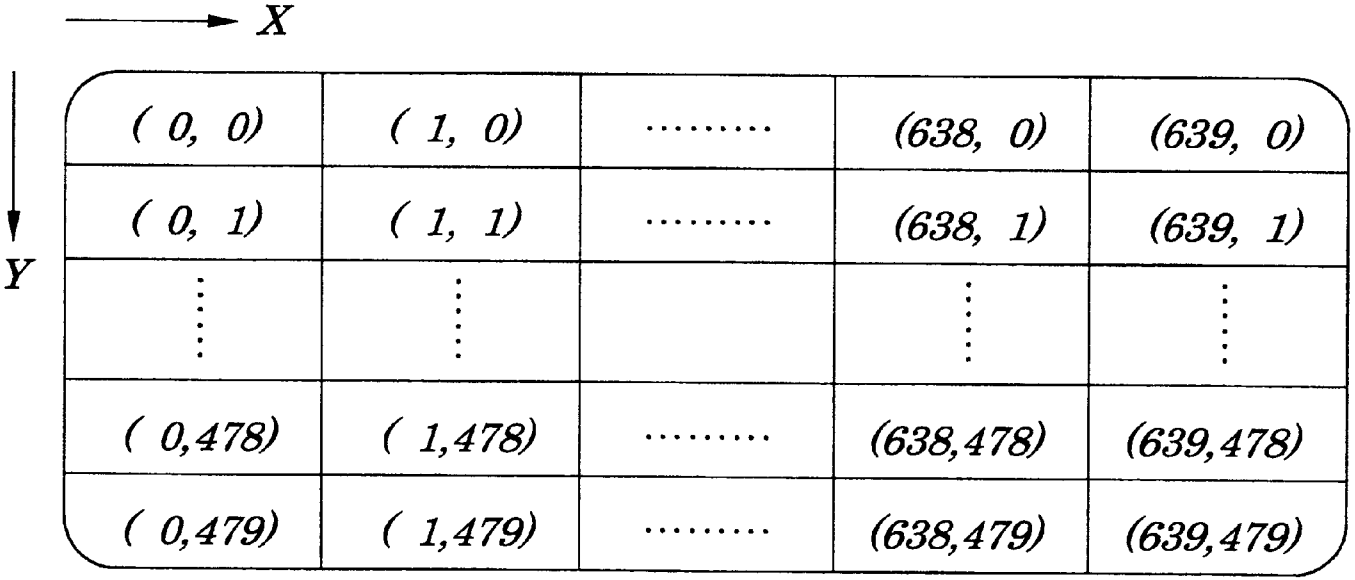
FIG.14 (PRIOR ART)
FIG. 14 is an explanatory view showing a relationship between each color element (dot) forming an image and the pixel values.
Figure 17:
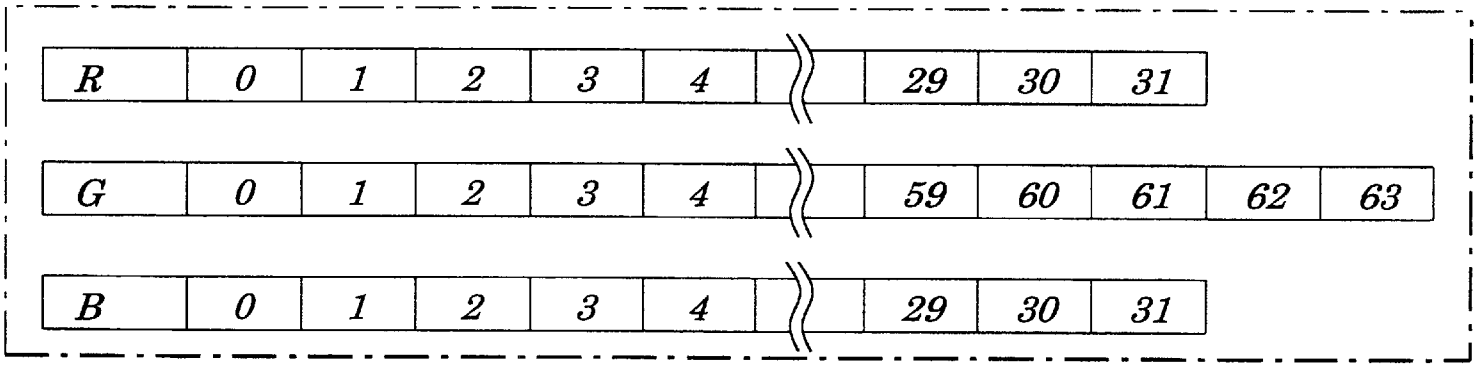
FIG.17 (PRIOR ART)
FIG. 17 is an explanatory view showing an ideal gray shade registers being able to be applied to the LCD controller described above.

FIG. 14 is an explanatory view showing a relationship between each color element (dot) forming an image and the pixel values, which shows an image being 640 dots wide and 480 dots long.

As shown in FIG. 14, assuming that values existing at the upper-left portion on the image are (0, 0), values (1, 0) . . . (638, 0) and (639, 0) are disposed toward the right portion on the image and values (0, 1) . . . (0, 478) and (0, 479) are disposed downward on the image.

At this point, the frame rate controlling section 3 is adapted to select either of a frame rate controlling pattern A or B in accordance with low order 1 bit of each of the values x and y described above.

FIG. 7 is an explanatory view showing which frame rate controlling pattern A or B is selected by the frame rate controlling section 3 in accordance with values x and y (low order 1 bit). FIGS. 16A and 16B are explanatory views showing contents of the frame rate controlling pattern A and B respectively. In the case of the frame rate controlling patter A, if the frame function is zero (0), the 0-th bit of the gray shade register is used for displaying and, similarly, if the frame function is 1, 2, or 3, the 1-st, 2-nd or 3-rd bit of the gray shade register is used for displaying. On the other hand, in the case of the frame rate controlling pattern B, if the frame function is zero (0), the 1-st bit of the gray shade register is used for displaying and similarly if the frame function is 1, 2 or 3, the 2-nd, 3-rd or 0-th bit is used for displaying as well.

Moreover, the frame rate controlling section 3 selects a specified one bit of data corresponding to a value of the frame function, out of gray shade data stored in the gray shade register selected by Step Sa1 in accordance with the frame rate controlling pattern selected by Step Sa2.

Figure 8:
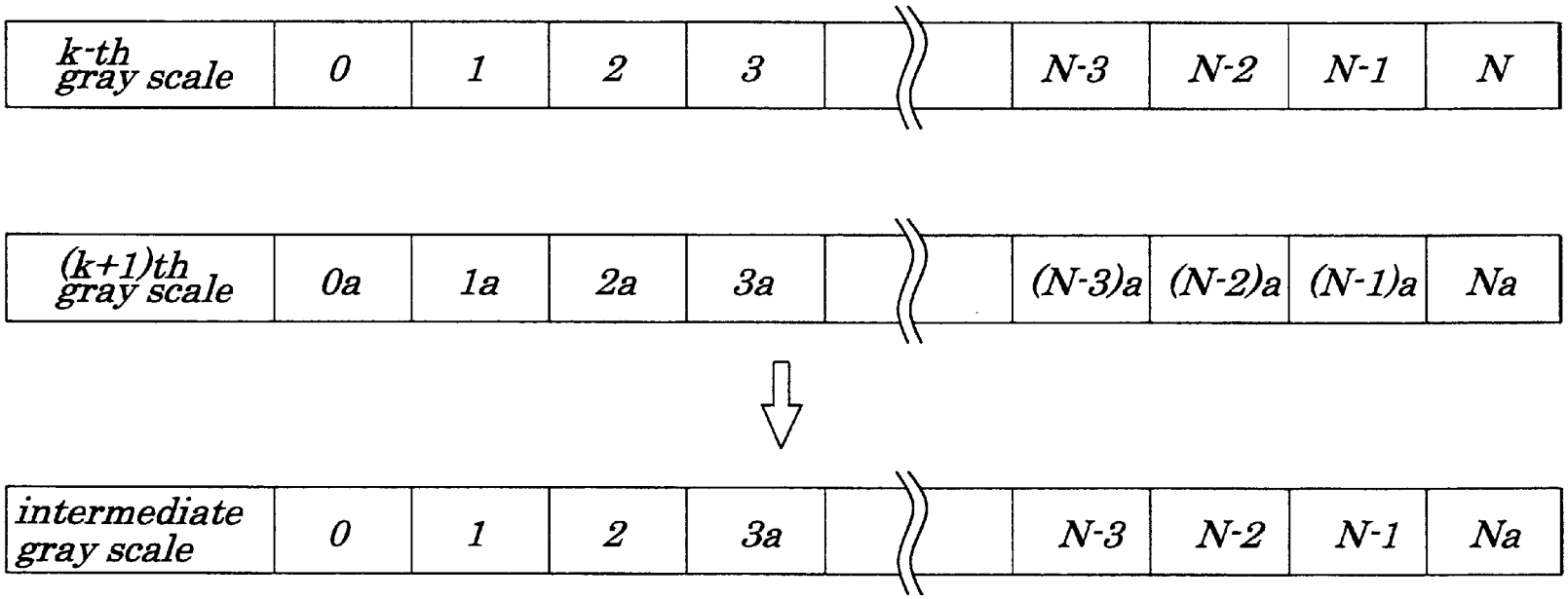
FIG. 8 is an explanatory view showing an application example of the embodiment.

FIG. 8 is an explanatory view showing an application example of the embodiment. In the STN-type or DSTN-type color gray shade displaying device provided with two or more gray shade registers for each of the RGB colors, when a color is displayed in any shade of gray exceeding the number of mounted gray shade registers, according to the embodiment of the present invention, as shown in FIG. 8, as part of values of the frame function, by using data of a gray shade register providing other shade of gray or data of a table prepared separately, the gray-scale color being darker by one gray scale or lighter by one gray scale can be displayed.

Figure 9:
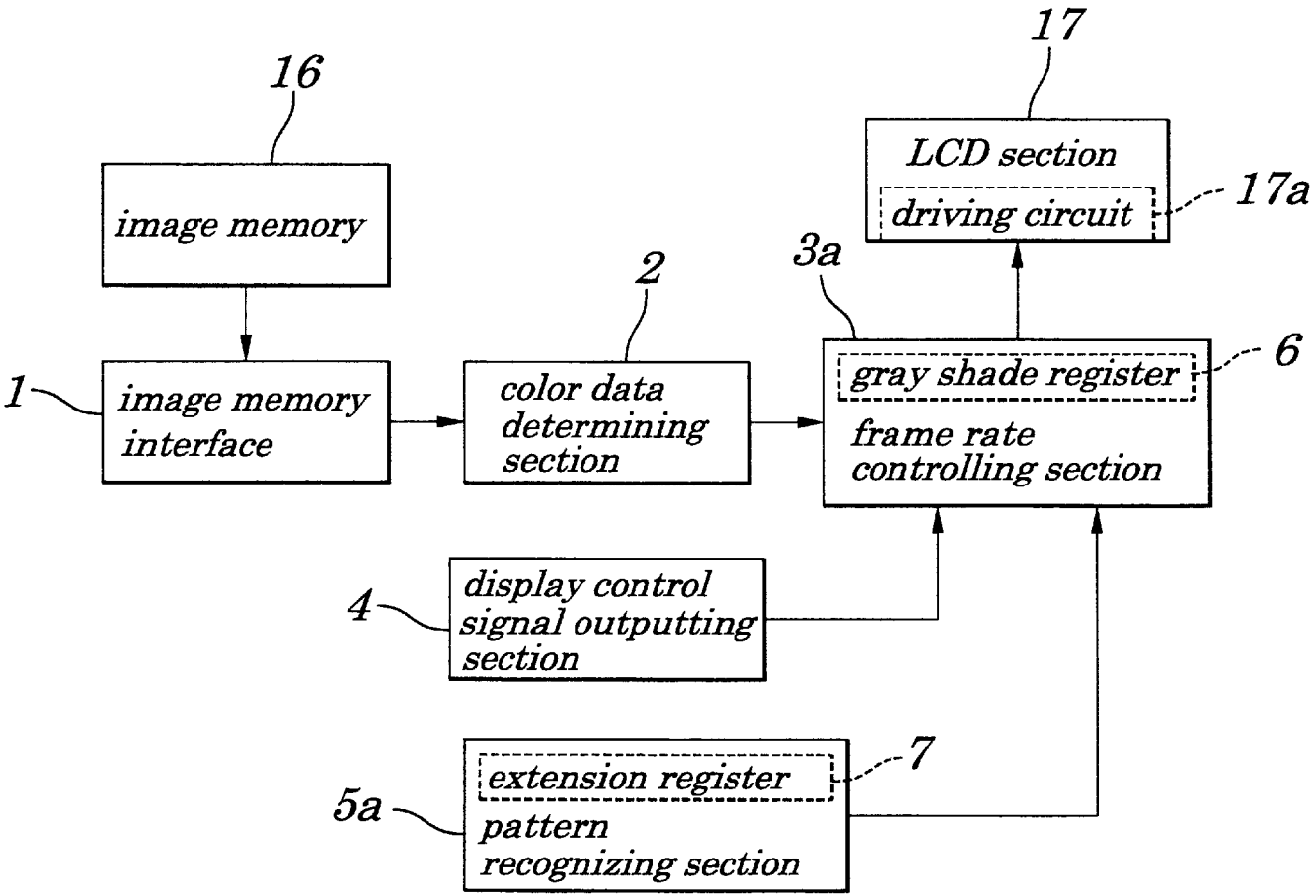
FIG. 9 is a block diagram showing configurations of the gray shade displaying device according to another embodiment of the present invention.
Figure 10:
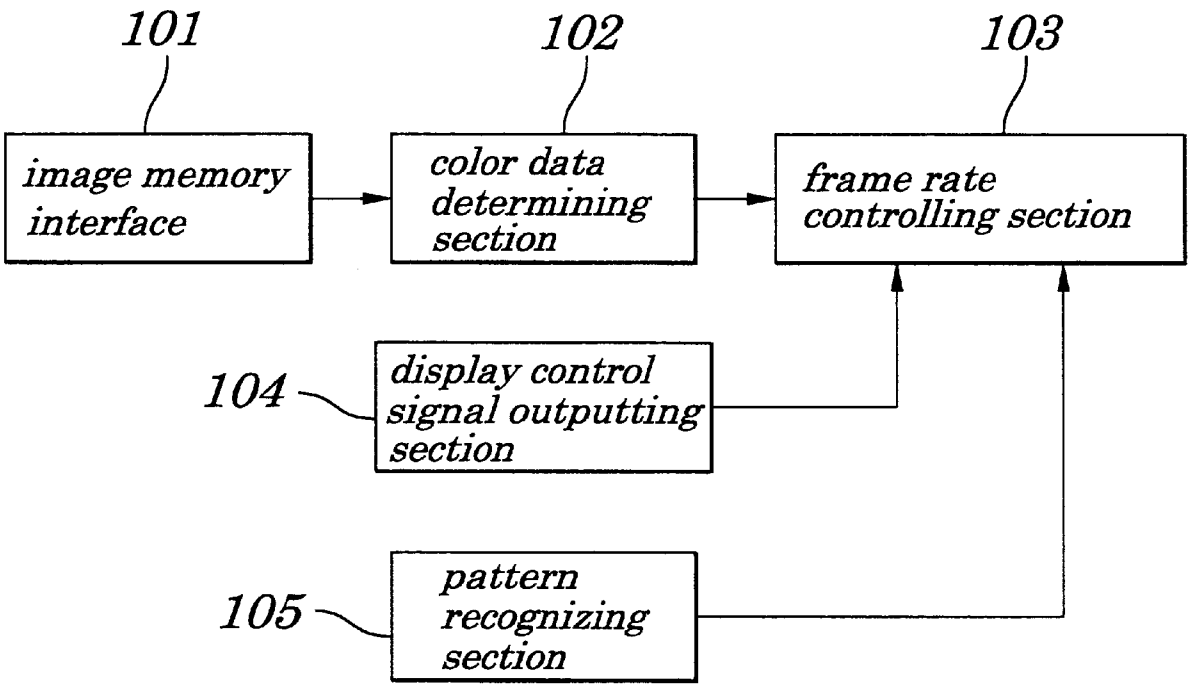
FIG. 10 (PRIOR ART)
FIG. 10 is a block diagram showing configurations of a conventional LCD controller used to display an image on an STN-type or DSTN-type color LCD panel.
Figure 11A:
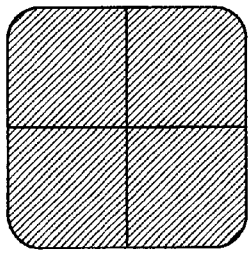
FIG. 11A (PRIOR ART)
FIGS. 11A to 11C are explanatory views showing one example of methods for gray shade display on the LCD panel.
Figure 11B:
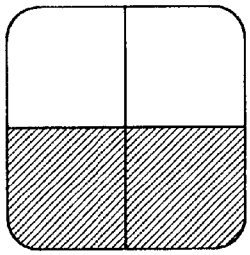
FIG. 11B (PRIOR ART)
Figure 11C:
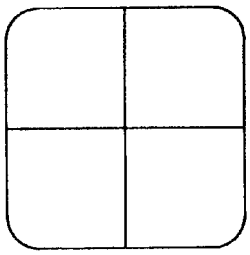
FIG. 11C (PRIOR ART)
Figure 12:
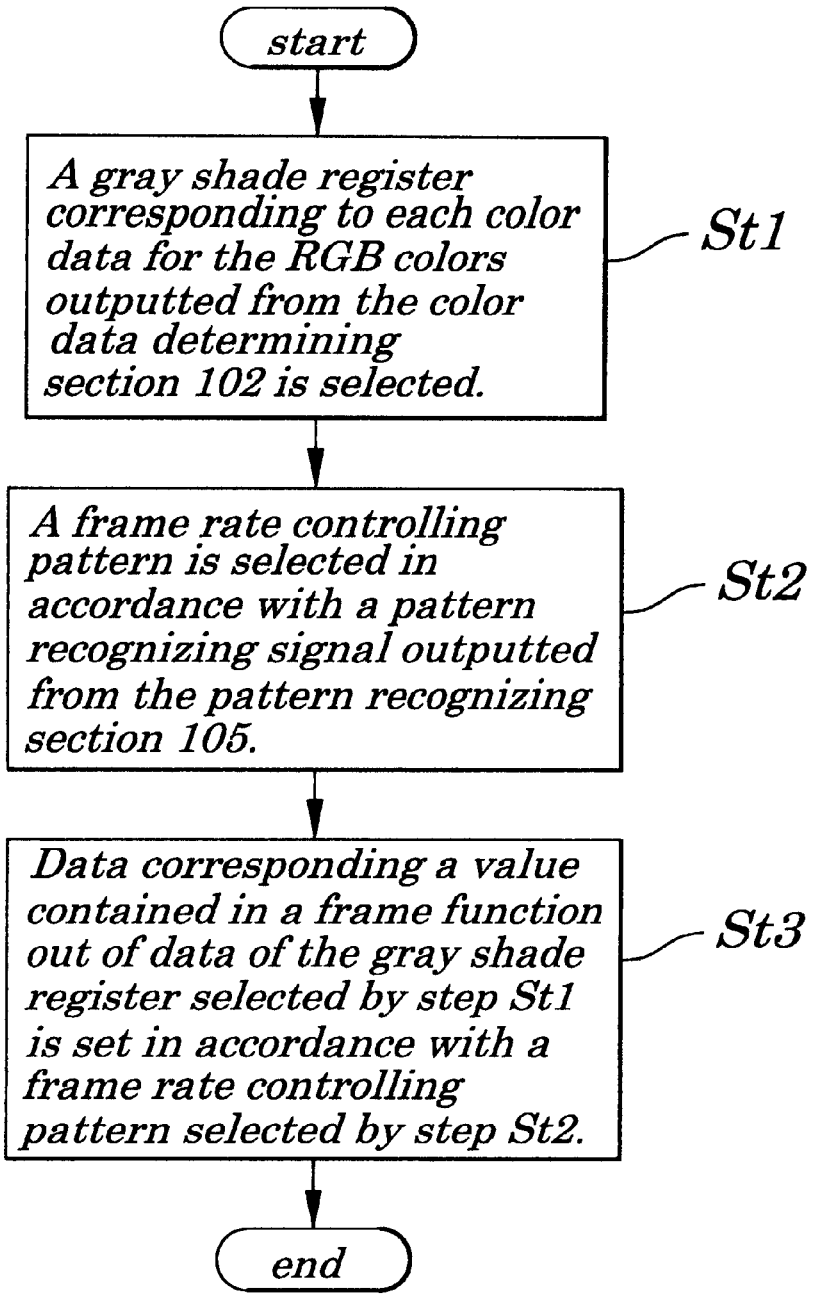
FIG. 12 (PRIOR ART)
FIG. 12 is a flowchart indicating one example of flows of processing by the LCD controller used in the conventional gray shade display.

FIG. 9 is a block diagram showing configurations of the gray shade displaying device according to another embodiment of the present invention. The same reference numbers in FIG. 9 designate corresponding parts shown in FIG. 2 and their descriptions are omitted. Unlike in the case of the embodiment shown in FIG. 2, in FIG. 9, the extension register 7 is mounted within the pattern recognizing section 5*a* and the frame rate controlling section 3*a* has the gray shade register 6. Except these, the configurations of this embodiment is the same as those shown in FIG. 2.

Thus, unlike in the case where gray shade tables composed of 32 bits for red and blue colors and of 64 bits for green color are prepared respectively, according to methods of designing of the present invention, an increase in the size of internal circuits can be avoided while the number of shades of gray can be increased.

In the embodiments described above, examples of the application of the present invention to the STN-type or DSTN-type LCD, it is also possible to apply the present invention to a TFT-type LCD, plasma display or CRT display or the like.

Moreover, the present invention is not limited to the color display. Monochrome display in multiple shades of gray are possible effectively.

As described above, according to the present invention, by determining color data corresponding to given image data using the color data determining means, by providing a display pattern corresponding to the color data, and by deciding specified gray shade data by controlling the color data using the frame rate controlling means, whether a gray-scale color is displayed or not is decided by the extension register provided within the pattern recognizing means. Moreover, by determining color data corresponding to given image data using the color data determining means, by providing a display pattern corresponding to the color data using the pattern recognizing means and by deciding gray shade data with a specified shade of gray using the frame rate controlling means, whether the gray-scale color is displayed or not is decided by the extension register provided within the pattern recognizing means. Also, by using N bits of gray shade registers providing different display patterns and by using data of a gray shade register providing a higher shade of gray by one as a first bit out of N bits of gray shade registers, the gray-scale color can be displayed in N shades of gray. Furthermore, because the AND of specified low order bits of color data is computed and, if the resulting ANDed value is zero (0), the color data is judged to be the gray-scale color, the gray shade displaying device and the method of displaying gray shades wherein its circuit configurations can be simplified, thus reducing power consumption and related costs and allowing values of products using the device and method to be maintained high.

In addition, the number of registers to be used may be reduced by using a set value giving other shade of gray as a first frame of the original gray shade register. This allows the size of the circuit to be reduced, thereby avoiding an increase in power consumption.

If the size of the circuit can be made small, it is possible to reduce not only costs but also as an area occupied by an LSI (large scale integrated circuit) containing the device on a circuit board.

It is apparent that the present invention is not limited to the above embodiments but may be changed and modified without departing from the scope and spirit of the invention.

Finally, the present application claims the priority based on Japanese Patent Application No. Hei10-333353 filed on Nov. 10, 1998, which is herein incorporated by reference.

What is claimed is:

1. A gray shade displaying device comprising:

a color data determining means to determine color data corresponding to given image data;

a pattern recognizing means to provide a display pattern corresponding to said color data and to decide shades of gray corresponding to color elements for RGB (red, green and blue) colors to which said determined color data belongs; and a frame rate controlling means having two or more gray shade registers to decide gray shade data providing a specified shade of gray by giving frame rate control to said color data and to decide a frame function to which each color element is allocated, whereby said frame rate controlling means has an extension register to decide whether an intermediate gray shade is displayed or thinned out in a current frame of said image data.

2. The gray shade displaying device according to claim 1, further including N bits of gray shade registers each giving a different display pattern and wherein an intermediate gray shade is displayed in N shades of gray by using data contained in said gray shade register providing a higher shade of gray by one as one bit out of N bits of said gray shade registers.

3. A gray shade displaying device comprising:

a color data determining means to determine color data corresponding to given image data;

a pattern recognizing means to provide a display pattern corresponding to said color data and to decide shades of gray corresponding to color elements for RGB (red, green and blue) colors to which said determined color data belongs; and a frame rate controlling means to decide gray shade data providing a specified shade of gray by giving frame rate control to said color data and to decide a frame function to which each color element is allocated, whereby said frame rate controlling means has an extension register to decide whether an intermediate gray shade is displayed or not;

wherein it is provided with N bits of gray shade registers each giving a different display pattern and wherein an intermediate gray shade is displayed in N shades of gray by using data contained in said gray shade register providing a higher shade of gray by one as one bit out of N bits of said gray shade registers; and wherein the AND of specified low order bits of said color data is computed and, when said ANDed value is zero (0), said color data is judged to be said intermediate gray shade.

4. A gray shade displaying device comprising:

a color data determining means to determine color data corresponding to given image data;

a pattern recognizing means to provide a display pattern corresponding to said color data and to decide shades of gray corresponding to color elements for RGB (red, green and blue) colors to which said determined color data belongs; and a frame rate controlling means having two or more gray shade registers to decide gray shade data providing a specified shade of gray by giving frame rate control to said color data and to decide a frame function to which each color element is allocated, whereby said frame rate controlling means has an extension register to decide whether an intermediate gray shade is displayed or thinned out in a current frame of said image data.

5. The gray shade displaying device according to claim 4, further including N bits of gray shade registers each giving a different display pattern and wherein an intermediate gray shade is displayed in N shades of gray by using data contained in said gray shade register providing a higher shade of gray by one as one bit out of N bits of said gray shade registers.

6. A gray shade displaying device comprising:

a color data determining means to determine color data corresponding to given image data;

a pattern recognizing means to provide a display pattern corresponding to said color data and to decide shades of gray corresponding to color elements for RGB (red, green and blue) colors to which said determined color data belongs; and a frame rate controlling means to decide gray shade data providing a specified shade of gray by giving frame rate control to said color data and to decide a frame function to which each color element is allocated, whereby said frame rate controlling means has an extension register to decide whether an intermediate gray shade is displayed or not;

wherein it is provided with N bits of gray shade registers each giving a different display pattern and wherein an intermediate gray shade is displayed in N shades of gray by using data contained in said gray shade register providing a higher shade of gray by one as one bit out of N bits of said gray shade registers; and wherein the AND of specified low order bits of said color data is computed and, when said ANDed value is zero (0), said color data is judged to be said intermediate gray shade.

7. A method of displaying gray shades comprising the steps of:

deciding color data corresponding to given image data by using color data determining means;

providing a display pattern corresponding to said color data by using pattern recognizing means;

deciding gray shade data providing a specified shade of gray by giving frame rate control to said color data by using frame rate controlling means; and deciding whether an intermediate gray shade is displayed or thinned out by using extension register means provided within said frame rate controlling means.

8. The method of displaying gray shades according to claim 7, further including N bits of gray shade registers each providing a different display pattern and wherein an intermediate gray shade is displayed in N shades of gray by using data of said gray shade register providing a higher shade of gray by one as one bit out of N bits of gray shade registers.

9. A method of displaying gray shades comprising the steps of:

deciding color data corresponding to given image data by using said color data determining means;

providing a display pattern corresponding to said color data by using said pattern recognizing means;

deciding gray shade data providing a specified shade of gray by giving frame rate control to said color data by using frame rate controlling means; and deciding whether an intermediate gray shade is displayed or not by using said extension register provided within said frame rate controlling means;

wherein it is provided with N gray shade registers each providing a different display pattern and wherein an intermediate gray shade is displayed in N shades of gray by using data of said gray shade register providing a higher shade of gray by one as one bit out of N bits of gray shade registers; and wherein the AND of specified low order bits of said color data is computed and, when said ANDed value is zero (0), said color data is judged to be said intermediate gray shade.

10. A method of displaying gray shades comprising the steps of:

deciding color data corresponding to given image data by using color data determining means;

providing a display pattern corresponding to said color data by using pattern recognizing means;

deciding gray shade data providing a specified shade of gray by giving frame rate control to said color data by using frame rate controlling means; and deciding whether an intermediate gray shade is displayed or thinned out by using extension register means provided within said frame rate controlling means.

11. The method of displaying gray shades according to claim 10, further including N bits of gray shade registers each providing a different display pattern and wherein an intermediate gray shade is displayed in N shades of gray by using data of said gray shade register providing a higher shade of gray by one as one bit out of N bits of gray shade registers.

12. A method of displaying gray shades comprising the steps of:

deciding color data corresponding to given image data by using said color data determining means;

providing a display pattern corresponding to said color data by using said pattern recognizing means:

deciding gray shade data providing a specified shade of gray by giving frame rate control to said color data by using said frame rate controlling means; and deciding whether an intermediate gray shade is displayed or not by using said extension register provided within said frame rate controlling means;

wherein it is provided with N gray shade registers each providing a different display pattern and wherein an intermediate gray shade is displayed in N shades of gray by using data of said gray shade register providing a higher shade of gray by one as one bit out of N bits of gray shade registers; and wherein the AND of specified low order bits of said color data is computed and, when said ANDed value is zero (0), said color data is judged to be said intermediate gray shade.

* * * * *